United States Patent [19]

Kalinowski et al.

[11] 4,311,760

[45] Jan. 19, 1982

[54] METHOD FOR APPLYING MERCAPTOALKYL-CONTAINING POLYDIORGANOSILOXANES TO TEXTILE FIBERS

[75] Inventors: Robert E. Kalinowski, Auburn; Jonathan Lipowitz, Midland, both of Mich.

[73] Assignee: Dow Corning Corporation, Midland, Mich.

[21] Appl. No.: 822,474

[22] Filed: Aug. 8, 1977

Related U.S. Application Data

[63] Continuation-in-part of Ser. No. 729,498, Oct. 4, 1976, abandoned, which is a continuation-in-part of Ser. No. 689,395, May 24, 1976, abandoned.

[51] Int. Cl.[3] ..... B32B 25/02; B32B 25/20; B05D 3/02

[52] U.S. Cl. ..... 428/391; 427/387; 427/393.2; 427/393.4; 428/266; 428/447

[58] Field of Search ..... 427/387, 374, 390 C, 427/390 E; 260/46.5 R, 46 E, 25, 825, 824 R, 29.2 N, 46.5, 797, 448.2 N; 428/447, 391, 266

[56] References Cited

U.S. PATENT DOCUMENTS

| | | | |
|---|---|---|---|
| 2,464,231 | 3/1949 | Hersh | 260/46.5 E |
| 2,719,165 | 9/1955 | Cooper | 260/448.2 N |
| 3,078,292 | 2/1963 | Prober | 260/448.2 N |
| 3,314,982 | 4/1967 | Koerner et al. | 260/448.2 N |
| 3,382,196 | 5/1968 | Gowdy et al. | 260/448.2 N |
| 3,440,302 | 4/1969 | Speier et al. | 260/448.2 N |
| 3,481,962 | 12/1969 | Simmler et al. | 260/448.2 E |
| 3,493,424 | 2/1970 | Mohrlok et al. | 260/46.5 E |
| 3,509,193 | 4/1970 | Niederprüm | 260/448.2 N |
| 3,637,427 | 1/1972 | Tsuruta et al. | 427/390 E |
| 3,655,713 | 4/1972 | Le Grow | 556/406 |
| 3,694,480 | 9/1972 | Omietanski | 260/448.2 R |
| 3,983,272 | 9/1976 | Huber et al. | 428/266 |

*Primary Examiner*—Norman Morgenstern
*Assistant Examiner*—Janyce A. Bell
*Attorney, Agent, or Firm*—George A. Grindahl

[57] ABSTRACT

Condensation-polymer fibers, such as polyethylene terephthalate fibers, and cellulosic fibers, such as cotton, have their surface modified with certain polydiorganosiloxanes to provide improved properties such as water repellency, hand, and tear strength to fabrics comprising the treated fibers. The polydiorganosiloxanes must contain at least two silicon bonded HSR'-groups wherein R' is a divalent or a trivalent saturated hydrocarbon radical or at least one HSR'-group and at least one —OR'' radical bonded to silicon. Exemplary is a polyester fabric which is treated with an aqueous emulsion of $$HSCH_2CH_2CH_2Si(OCH_3)_2O(\overset{\overset{CH_3}{|}}{\underset{\underset{CH_3}{|}}{Si}}O)_{25}Si(OCH_3)_2CH_2CH_2CH_2SH$$

and dried to provide a textile having improved hand.

11 Claims, No Drawings

METHOD FOR APPLYING MERCAPTOALKYL-CONTAINING POLYDIORGANOSILOXANES TO TEXTILE FIBERS

This application is a continuation-in-part of application Ser. No. 729,498, filed on Oct. 4, 1976 and now abandoned, which is a continuation-in-part of application Ser. No. 689,395, filed on May 24, 1976 and now abandoned.

BACKGROUND OF THE INVENTION

This invention relates to a method for treating textile fibers and to the modified fibers obtained thereby. More specifically this invention relates to a process for durably affixing a polydiorganosiloxane to surface of a condensation-polymer fiber or a cellulosic fiber without using a curing component for crosslinking the polydiorganosiloxane.

It has long been known to apply a curable organopolysiloxane composition to a fabric or fiber and to subsequently cure the applied organopolysiloxane by the action of a second curing component to produce a fiber or fabric that is surrounded by, i.e. encased in, a sheath of the cured organopolysiloxane composition.

However, a two-component curable composition has certain deficiencies. For example, said curable compositions must often be prepared, shipped, and stored in two or more non-curing packages, which are mixed shortly before the intended time of use, in order, to avoid premature curing of the composition. This requirement is costly and time consuming. Furthermore, relatively large amounts of a two-component curable composition must be added to a fabric or fiber in order to provide sufficient integrity for the cured composition to resist mechanical removal, such as by abrasion.

Another method for modifying the surface of a synthetic material is disclosed by Lipowitz in U.S. application Ser. No. 689,395, titled "Non-Crosslinked-Silicone-Coated Thermoplastic and Process Therefor," filed May 24, 1976 and assigned to the assignee of this invention. Therein a non-crosslinked silicone is durably affixed to a surface of a thermoplastic by applying a non-crosslinking silicone to the thermoplastic at a temperature greater than the glass-transition temperature but less than the melting temperature of the thermoplastic. However, the resulting silicone treatment is durable only at temperatures below said glass-transition temperature.

Gowdy, et al, U.S. Pat. No. 3,535,145 claims a process of applying certain mercaptohydrocarbon-substituted organosilicon compounds to the surface of a vinylic polymer and applying heat or actinic radiation energy to the surface of said vinylic polymer to irreversibly attach said organosilicon compound to said vinylic polymer. Gowdy, et al. teaches that only vinylic polymers may be altered by the application of an organosilicon compound containing at least one mercaptohydrocarbon radical.

We have found that certain polydiorganosiloxane fluids comprising saturated hydrocarbon radicals bearing mercaptan groups may be durably affixed to non-vinylic polymer fibers.

SUMMARY OF THE INVENTION

It is an object of the present invention to provide a process for durably affixing a crosslinked polydiorganosiloxane to a surface of fibers without using a crosslinking component to cure the polydiorganosiloxane.

It is another object of this invention to durably improve the hand of textiles.

It is a further object of this invention to durably affix a relatively small quantity of a crosslinked polydiorganosiloxane to a surface of a fiber.

These and other objects are achieved by applying to a condensation-polymer fiber or a cellulosic fiber a liquid composition consisting essentially of certain polydiorganosiloxanes which bear an average of at least one silicon-bonded, mercapto-containing saturated hydrocarbon radical and at least one other of said mercapto-containing radicals or a lower alkoxy radical per molecule of polydiorganosiloxane.

By fiber it is meant a fiber or filament consisting essentially of a condensation polymer or a cellulosic polymer along with any other of the components commonly used in synthetic or natural fibers such as delusterants, fire-control additives, and colorants.

By fiber it is further meant a single fiber or filament, or a plurality of fibers comprising condensation-polymer fibers or cellulosic fibers, such as fiberfill, a bundle or tow of fibers or filaments, a yarn, a thread or a fabric such as a woven fabric, an agglomerated random fabric and a knitted fabric.

By condensation-polymer fiber it is meant herein a fiber that is prepared from a polymer made by a non-vinylic process such as by intercondensation by deamination of a dicarboxylic acid and a diamine with the atendant liberation of ammonia or by dehydration of a dicarboxylic acid and diol with the attendant liberation of water, or the ring-opening polymerization of a lactam with essentially no liberation of a by-product to give rise to a condensation-type polymer.

By cellulosic fiber it is meant herein a fiber of cellulose such as cotton, linen and sisal; of regenerated cellulose such as rayon; and of derived cellulose such as cellulose acetate.

DESCRIPTION OF THE INVENTION

This invention relates to a method for treating a condensation-polymer fiber or a cellulosic fiber which comprises applying to said fibers a liquid composition consisting essentially of a polydiorganosiloxane having a viscosity of at least 20 millipascal-seconds at 25° C., said polydiorganosiloxane consisting essentially of (A) siloxane units of the unit formula $R_nSi(OR'')_mO_{(4-m-n)/2}$ wherein m=0, 1 or 2, n=1, 2 or 3 and the sum of m+n=2 or 3, R denotes a silicon-bonded radical free of aliphatic unsaturation selected from the group consisting of monovalent hydrocarbon radicals and halogenated monovalent hydrocarbon radicals and R'' denotes a lower alkyl radical and, (B) siloxane units of the unit formula $HSR'SiR_x(OR'')_yO_{(d-x-y)/2}$ wherein R and R'' are as denoted above, R' denotes a divalent saturated hydrocarbon radical having one valence bonded to the silicon atom and one valence bonded to the sulfur atom or a trivalent saturated hydrocarbon radical having two valences singly bonded to the silicon atom and one valence bonded to the sulfur atom, the values of d, x, and y being such that when R' is divalent d=3, x=0, 1 or 2, y=0, 1 or 2 and the sum of x+y=1 or 2 and when R' is trivalent d=2, x=0 or 1, y=0 or 1 and the sum of x+y=0 or 1, there being an average of at least one HSR'-radical in addition to at least one —OR'' radical or another HSR'-radical in the polydiorganosiloxane and heating the applied polydiorganosiloxane whereby there is obtained a fiber having durably affixed to the surface thereof a crosslinked polydiorganosiloxane.

Fibers which are operable in the process of this invention are the fibers consisting essentially of a condensation polymer and/or cellulosic polymers hereinbefore defined. Condensation-polymer fibers which are of particular interest for the purposes of this invention are the polyamides, such as the nylons and polyesters such as polyethylene terephthalate, herein also denoted by PET, that are used to prepare oriented and non-oriented textiles such as filaments, threads, yarns, fibers; fabrics such as woven fabrics, knitted fabrics, and random or non-woven fabrics and fiberfill. Such fibers experience the greatest improvement in hand in the process of this invention.

The liquid composition that is applied to a surface of a fiber in accordance with this invention consists essentially of a polydiorganosiloxane. The liquid composition may consist solely of the liquid polydiorganosiloxane. In those cases where the polydiorganosiloxane is not a liquid under ambient conditions, a liquid composition may be prepared by any suitable method. For example, a liquid composition may be prepared by dissolving or dispersing or emulsifying a suitable non-liquid polydiorganosiloxane in a suitable medium such as an organic liquid or water. Of course, it should be understood that a liquid polydiorganosiloxane may be used in place of or in addition to a non-liquid polydiorganosiloxane in said suitable method for preparing a liquid composition. By ambient conditions it is meant the conditions of time, temperature and pressure that are used during the treating of the fiber according to the process of this invention. Thus, it is within the scope of this invention to apply a composition which may be non-liquid at room temperature but which will be a liquid at a higher temperature that may be used in the method of this invention. The liquid composition may also contain non-essential components such as pigments, emulsifying agents, fire-retardant additives, plasticizers, anti-static agents and perfumes, when desired.

In many instances it is desirable to apply and durably affix a very small amount, for example, less than 1 percent by weight, based on the weight of the fiber, of polydiorganosiloxane to a surface of a fiber. To this end it is often desirable to prepare a dilute solution or a suspension or an emulsion of the polydiorganosiloxane and apply the resulting liquid composition to the fiber.

The viscosity of the liquid composition is not critical. The liquid composition should be sufficiently fluid to permit its use in the method of this invention, i.e. it should be applicable to the desired surface of the fiber at ambient conditions. The volatility of the polydiorganosiloxane should be sufficiently low so that at least a portion of it will remain in contact with the surface of the fiber at ambient conditions so that it is durably affixed to the surface of the fiber.

The polydiorganosiloxane has a viscosity at 25° C. of at least 20 millipascal-seconds (20 cp). There is no critical upper limit for the viscosity of the polydiorganosiloxane. Preferable results, with respect to the hand of a textile, are obtained if the viscosity of the polydiorganosiloxane that is used to treat the fibers of the textile has a viscosity of less than approximately 100 pascal-seconds, optimally less than 10 pascal-seconds.

The polydiorganosiloxane consists essentially of two types of siloxane units, i.e. (A) siloxane units which bear only sulfur-free organic radicals and (B) siloxane units which bear sulfur-containing organic radicals. Each of these siloxane units may be a difunctional unit, i.e. a polymer-chain unit or a monofunctional unit, i.e. an endblocking unit. It is to be understood that the polydiorganosiloxane may also comprise minor amounts of $SiO_{4/2}$ siloxane units and trifunctional siloxane units as long as the polydiorganosiloxane is not gelled. There may also be present in the polydiorganosiloxane small amounts of silicon-bonded hydroxyl radicals.

The polydiorganosiloxane may consist essentially of any combination of (A) siloxane units and (B) siloxane units as long as there is at least to mercaptoalkyl radicals or one mercaptoalkyl radical and one lower alkoxy radical in the polydiorganosiloxane. The (B) siloxane units may be polymer-chain units and/or endblocking units and may bear, independently, a divalent and/or a trivalent sulfur-containing radical hereinafter described. Preferably the (B) siloxane units do not comprise more than about 10 percent of all siloxane units in the polydiorganosiloxane.

Sulfur-free siloxane units have the unit formula $$R_nSi(OR'')_mO_{(4-m-n)/2} \qquad (A)$$

In the (A) siloxane units the value of n may be independently an integer from 1 to 3 inclusive and m may be independently an integer from 0 to 2 inclusive with the limitation that in any siloxane unit (A) the total value of m+n has a value of 2 or 3. Thus siloxane units (A) which are difunctional, and hence occupy polymer-chain locations in the polydiorganosiloxane, include $R_2SiO_{2/2}$ and $RSi(OR'')O_{2/2}$ whereas siloxane units (A) which are endblocking units in the polydiorganosiloxane, and hence are monofunctional, include $R_3SiO_{1/2}$, $R_2Si(OR'')O_{1/2}$ and $RSi(OR'')_2O_{1/2}$.

The R'' radicals of the (A) siloxane units may be lower alkyl radicals having from 1 to 6 inclusive radicals such as methyl, ethyl, isopropyl, butyl, t-butyl and hexyl, but preferably R'' is methyl.

The R radicals of the (A) siloxane units contain from 1 to 18 carbon atom inclusive and are free of aliphatic unsaturation. They may be monovalent hydrocarbon radicals such as lower alkyl radicals hereinbefore defined and higher alkyl radicals such as octyl, isooctyl, decyl and octadecyl, cycloaliphatic radicals such as cyclohexyl and methylcyclopentyl; aryl radicals such as phenyl, aralkyl radicals such as benzyl and alkaryl radicals such as tolyl; and/or halogenated monovalent hydrocarbon radicals such as 3-chloropropyl, 3,3,3-trifluoropropyl, chlorophenyl, α,α,α-trifluorotolyl and pentafluorobenzyl. Preferably R is methyl.

Sulfur-containing siloxane units have the unit formula $$HSR'SiR_x(OR'')_yO_{(d-x-y)/2} \qquad (B)$$

In the (B) siloxane units the R and R'' radicals are independently, as delineated above for the (A) siloxane units. Preferably R and R'' are methyl in the (B) siloxane units.

The R' radical is a saturated divalent radical or a saturated trivalent radical which is bonded to the silicon atom through at least one carbon-silicon bond and to the sulfur atom through a carbon-sulfur bond. Examples of divalent R' radicals include $—CH_2—$, $—CH_2CH_2—$, $—CH_2CH_2CH_2—$, $—CH(CH_3)CH_2—$, $—CH_2CH_2CH_2CH_2—$,

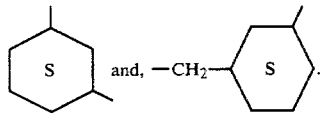

The propylene radical is preferred. Examples of trivalent R′ radicals include $$-CH_2CH_2\overset{|}{C}HCH_2-,\ -CH_2CH_2CH_2\overset{|}{C}H-,$$

$$-CH_2CH(CH_3)\overset{|}{C}HCH_2-,\ -CH_2CH(CH_3)\overset{|}{C}(CH_3)CH_2-,$$

$$-CH_2CH_2\overset{|}{C}HCH_2CH_2-\ -CH_2\overset{|}{C}HCH_2CH(CH_3)-\ \text{and}$$

$$-CH_2CH_2CH_2\overset{|}{C}HCH_2-.$$

Trivalent R′ radicals are bonded to the silicon atom through single bonds from two of its carbon atoms, said carbons being separated by at least one carbon atom which is not bonded to the silicon atom.

The values of d, x and y in (B) may vary depending upon the nature of the R′ radical.

Thus, when R′ is trivalent, d is equal to 2 and the values of x, y and x+y are independently 0 or 1. Difunctional, i.e. polymer-chain, (B) siloxane units in the polydiorganosiloxane which bear a sulfur-containing trivalent radical include $HSR'SiO_{2/2}$. Monofunctional, i.e. endblocking, (B) siloxane units in the polydiorganosiloxane bearing a sulfur-containing trivalent radical include $HSR'Si(R)O_{1/2}$ and $HSR'Si(RO'')O_{1/2}$.

When R′ is divalent, d is equal to 3 and x and y are independently 0, 1 or 2 with the limitation that in any (B) siloxane unit the total value of x+y is 1 or 2. Monofunctional (B) siloxane units in the polydiorganosiloxane which bear a divalent R′ radical include $HSR'Si(R)_2O_{1/2}$, $HSR'Si(OR'')_2O_{1/2}$, and $HSR'Si(R)(OR'')O_{1/2}$. Difunctional (B) siloxane units in the polydiorganosiloxane which bear a divalent R′ radical include $HSR'Si(R)O_{2/2}$ and $HSR'Si(OR'')O_{2/2}$.

Trifunctional siloxane units which may be present in minor quantities in the polydiorganosiloxane include $R''OSiO_{3/2}$, $RSiO_{3/2}$, and $HSR'SiO_{3/2}$ wherein R′ is divalent.

Preferred siloxane units for the polydiorganosiloxane include $Me_2SiO_{2/2}$, $Me_3SiO_{1/2}$, $HS(CH_2)_3Si(Me)O_{2/2}$, $HS(CH_2)_3Si(OMe)_2O_{1/2}$, $HS(CH_2)_3Si(Me)_2O_{1/2}$, $MeSi(OMe)_2O_{1/2}$, $MeSi(OMe)O_{2/2}$, $HS(CH_2)_3Si(OMe)O_{2/2}$, $HS(CH_2)_3Si(Me)(OMe)O_{1/2}$,

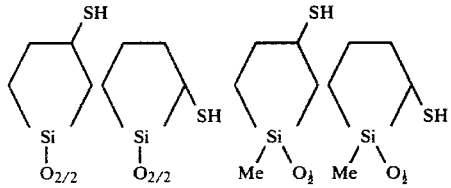

-continued

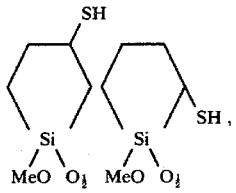

wherein Me=methyl. Polydiorganosiloxanes wherein at least 50 percent of the silicon-bonded monovalent organic radicals are the methyl radical are preferred for modifying the surface properties of fibers. Polydiorganosiloxanes wherein a majority, preferably greater than 90 percent, of the siloxane units are dimethylsiloxane units are preferred for modifying the surface properties of textiles to produce improved hand.

A preferred polydiorganosiloxane for the method of this invention is a 3-mercaptopropyldimethoxysiloxane-endblocked polydimethylsiloxane fluid having a viscosity at 25° C. of from 50 to 5000 millipascal-seconds. Another preferred polydiorganosiloxane for the method of this invention is a trimethylsiloxane-endblocked polydiorganosiloxane having a viscosity at 25° C. of from 50 to 500 millipascal-seconds and consisting of a majority of $Me_2SiO$ siloxane units and a minority, preferably from 1 to 5 mol percent of $HS(CH_2)_3Si(Me)O_{2/2}$ siloxane units. Preferred liquid composition for the method of this invention are aqueous emulsions of said preferred polydiorganosiloxanes.

Suitable polydiorganosiloxanes for the method of this invention are known in the art.

Polydiorganosiloxanes bearing divalent R′ radicals are disclosed by Gowdy, et al., U.S. Pat. No. 3,535,145 which is hereby incorporated by reference to show the preparation of suitable sulfur-containing polydiorganosiloxanes.

Polydiorganosiloxanes bearing trivalent R′ radicals are disclosed by LeGrow, U.S. Pat. No. 3,655,713 which is hereby incorporated by reference to show the preparation of suitable sulfur-containing polydioranosiloxanes.

A preferred polydiorganosiloxane for the purposes of this invention may be prepared by mixing the appropriate quantities of $HSCH_2CH_2CH_2Si(OCH_3)_3$ and a hydroxyl-endblocked polydimethylsiloxane of the appropriate viscosity. As methanol is removed from the mixture a 3-mercaptopropyldimethoxysiloxane-endblocked polydimethylsiloxane fluid is obtained.

Another preferred polydiorganosiloxane for the purposes of this invention may be prepared by mixing the appropriate quantities of hexamethyldisiloxane, dimethylcyclopolysiloxane and methyl-3-mercaptopropyldimethoxy silane hydrolyzate in the presence of an equilibrating catalyst such as $CF_3SO_3H$ to provide a trimethylsiloxane-endblocked polydiorganosiloxane consisting of from 95 to 99 mol percent of dimethylsiloxane units and from 1 to 5 mol percent methyl-3-mercaptopropylsiloxane units.

In the process of this invention, the liquid composition may be applied to a surface of the fiber in any suitable matter such as by brushing, padding, rinsing, dipping, spraying, dusting, by thermal transfer processes and by fluid-bed methods. The liquid composition may be applied to the entire surface of the fiber or to any portion of the surface as desired.

The applied polydiorganosiloxane may be crosslinked by heating to a temperature of from above room temperature, preferably above approximately 50° C., to less than the melting or decomposing temperature of the fiber or polydiorganosiloxane. Of course the applied polydiorganosiloxane may optionally or additionally, be crosslinked with conventional means such as by the use of a catalyst and/or curing agent for silicon-bonded alkoxy radicals or sulfur-containing radicals, if desired. Any heating may be done at any convenient time providing the fiber is in contact with at least the polydiorganosiloxane for an effective length of time. By an effective length of time, it is meant a span of time at the particular heating temperature that is sufficient to allow the polydioroganosiloxane to be crosslinked and durably affixed to the surface of the fiber. Thus, the liquid composition must be exposed to said temperature during or after the applying of the liquid composition to the surface of the fiber. It is not recommended to heat the polydiorganosiloxane above approximately 100° C. before it is applied to the fiber since undesirable crosslinking of the unapplied polydiorganosiloxane may occur.

Heating the composition may be done by any suitable method or combination of methods such as with infrared radiation; a suitable hot fluid such as hot air or steam; electrical heating elements and microwave heating. Alternately, the liquid may be applied to a hot fiber.

An article whose fibers may be modified by the process of this invention may consist solely of the condensation-polymer fibers and/or cellulosic fibers or said article may comprise other components which are not condensation-polymer fibers or cellulosic fibers. For example, it is within the scope of this invention to treat the fibers of a textile which comprises additional fiber components such as wool fibers, glass fibers, vinylic-polymer fibers, or metalli fibers. The surface of these other components may or may not be concurrently modified.

After the fiber has been treated, i.e. having had the liquid composition applied and having been exposed to a suitable temperature as described above, the polydiorganosiloxane is crosslinked and is durably affixed to the surface of the fiber.

By durably affixed it is meant that the crosslinked polydiorganosiloxane cannot be washed from the surface of the fiber to a non-detectable level by 10 machine washings according to AATCC 124-1973 test method.

By crosslinked polydiorganosiloxane it is meant that the durably affixed polymer cannot be dissolved in toluene using any one of the following methods. Thus, the polydiorganosiloxane is crosslinked (i) if it cannot be dissolved from the surface of the fiber at a temperature below the melting temperature of the fiber or (ii) if, when the fiber is dissolved, melted or otherwise removed, leaving a polydiorganosiloxane polymer, said polymer is insoluble in toluene. Solvents for condensation-polymers and cellulosic polymers are well known to those skilled in the polymer art.

The method of this invention is of particular value for modifying the surface characteristics of a textile comprising a condensation-polymer fiber to provide a textile with improved properties such as improved hand, improved tear strength, increased water repellency and improved soil release.

It should be understood that the method of this invention may be used to modify an end-product comprising a fiber or said fiber may be so modified and subsequently fabricated to an end-product. For example, it is within the scope of this method to modify a cellulosic fiber and/or a condensation-polymer fiber or filament at any suitable point in its manufacturing process or thereafter and subsequently fabricate an article such as a yarn or a fabric from said modified fiber or filament. Alternately, a fabric may be fashioned comprising a cellulosic fiber and/or a condensation-polymer fiber or filament and, subsequently, at least the condensation-polymer fiber and cellulosic fiber portions of said fabric may be modified by said process.

The process of this invention is further illustrated by the following examples which teach the best mode for carrying out the invention; however, said examples should not be regarded as limiting the invention which is delineated by the appended claims.

EXAMPLE 1

A polyethylene terephthalate woven fabric (animal print) containing $TiO_2$ delusterant and approximately 4 percent by weight of tris(2,3-dibromopropyl) phosphate as a fire retardant was scoured by boiling it for 15 minutes in a 1 percent aqueous solution of Triton® X-100 (registered trademark of Rohm and Haas Co.) and was rinsed and dried. Three liquid compositions having the following compositions were applied to three samples of the scoured fabric. A fourth sample (control) of the scoured fabric received no liquid composition. Liquid composition A was a commercial fabric treatment which forms a crosslinked organosilicon polymer on the fabric. Liquid composition B was a preferred polydiorganosiloxane of this invention having a viscosity of 0.05 pascal-seconds wherein the organic groups were $—CH_3$, $—CH_2CH_2CH_2SH$ and $—OCH_3$. The $—OCH_3$ groups were hydrolyzable and were present in sufficient amounts to crosslink the polymer. Liquid composition C was a noncrosslinking trimethylsiloxane-endblocked polydiorganosiloxane bearing a majority of $—CH_3$ groups and a minority of $—(CH_2)_3SCH_2COOH$ groups bonded to silicon and having a viscosity of 0.2 pascal-seconds at 25° C. The treated samples were dried at 105° C. for 5 minutes.

The four samples of fabric were then heated to 205° C. for 90 seconds and cooled to room temperature. A piece of each fabric, 0.1 gram, was placed in one of four test tubes containing 20 ml. of an equal volume solution of phenol and ortho-dichlorobenzene, a solution known to dissolve polyethylene terephthalate, and heated to 100° C. for 1 hour. After the fabric had been dissolved, the test tubes which contained the fabrics that had been treated with liquid compositions A and B contained a toluene-insoluble, white, stringy substance, in addition to insoluble $TiO_2$, thus showing that the organosilicon polymer was crosslinked. The test tubes that contained the fabrics that had received no liquid composition and liquid composition C contained no insoluble substance, other than $TiO_2$ powder, thus showing that liquid composition C did not form a crosslinked organosilicon polymer. The insoluble, white, stringy, substance from test tubes A and B was removed from the test tubes, swelled in xylene and examined with an optical microscope at a magnification of 100 which revealed a sheath-like structure similar to the original fabrics.

EXAMPLE 2

Three samples of polyethylene terephthalate were padded with an emulsion of composition B of Example 1. One sample each of the padded samples was heated for 90 seconds at 80° C., 130° C. and 150° C., respectively. Each fabric was then dissolved in phenol/orthodichlorobenzene as in Example 1 and the insoluble residue was examined. Very small crosslinked residue particles were obtained from the fabric that had been heated at 80° C., more crosslinking was apparent in the insoluble particles that were obtained from the fabrics that had been heated at 130° C. and 150° C. This example shows that the extent of crosslinking of the polydiorganosiloxane is directly proportional to the heating temperature at constant time.

EXAMPLE 3

Two samples of the woven fabric of Example 1 were treated with mechanical aqueous emulsions of polymer B and polymer C using a bath concentration of 2 weight percent polymer. The fabric was scoured, rinsed, dried, padded, dried and heated for 90 seconds at 205° C., as in Example 2. The heated samples were cooled, rescoured, dried and weighed to determine the weight gain of the samples. Weight gain is the net result of the addition of polydiorganosiloxane and the removal of approximately 1.0 to 1.5 weight percent fire retardant from the fabric. The sample treated with polymer B gained approximately 2 weight percent. The sample treated with polymer C gained approximately 1.5 weight percent. Hand was judged as excellent for both samples.

EXAMPLE 4

The polyester fabric of Example 1 was scoured at 100° C. for 15 minutes in a 1 percent Triton® X-100 bath, rinsed with cold water in a household automatic washer and dried in a household automatic dryer. Samples of the dried fabric were padded at 40 psi with aqueous emulsions of polymers B and C of Example 1 and dried at 107° C. for 15 minutes. The dried, padded samples were heated at 205° C. for 90 seconds in an oven, cooled, rescoured at 77° C. for 15 minutes and rinsed and dried as above. Each sample was found to have approximately a 2 percent increase in weight after the above process. A control sample was also processed as the above except that the padding step was omitted.

The samples were evaluated for hand, tear strength, and flame retardance immediately after being processed, after being washed 10 times and after being dry cleaned (D/C) 10 times. Results are summarized in Table I. The hand test is a measure of the feel of the fabric in hand and is described in qualitative terms. Tear strength was measured in pounds (force) according to ASTM D-2261-71 in both the fill and warp directions. Only warp data are given (converted to newtons for this application by multiplying by 4.448222 and rounding off) because fill data were essentially the same as the warp data. Flammability was measured as char length according to DOC FF 3-71 and DOC PFF 5-74. Note that both sample B and sample C have good hand improvement and better tear strength than the control, initially and after 10 washes; however, sample C and the control passed the flame retardance test (DOC PFF 5-74) while sample B, which bears the crosslinked organosilicon polymer failed this flame retardance test. This example demonstrates the durability of the treatment of this invention to washing and dry cleaning.

TABLE I

| Observation | Control | Sample B | Sample C |
|---|---|---|---|
| Hand | | | |
| Initial | Soft<br>Fair body | Soft<br>Good body | Very soft<br>Fair body |

TABLE I-continued

| Observation | Control | Sample B | Sample C |
|---|---|---|---|
| After 10 washes | Soft<br>Limp | Very Soft<br>Good body | Soft<br>Good body |
| Tear Strength (N) | | | |
| Initial | 44.0 | 63.2 | 72.1 |
| After 10 washes | 37.8 | 69.8 | 61.4 |
| After 10 D/C | 28.9 | 51.8 | 31.1 |
| Char Length (mm) | | | |
| Initial | 90.2 | Samples burned completely (254 mm.) | 120.7 |
| After 10 washes | 92.7 | | 83.8 |
| After 10 D/C | 86.4 | | 83.8 |

EXAMPLE 5

Polyethylene terephthalate fabric was exposed at 205° C. for 90 seconds in contact with several organosilicon polymers of the general formula $(CH_3)_3Si\text{-}O\{(CH_3)_2SiO\}_x\text{—}\{(CH_3)(HSCH_2CH_2CH_2)Si\text{-}O\}_ySi(CH_3)_3$ according to the method of this invention. Crosslinked polymers were formed on the thermoplastic when the average x and y values were 75 and 3 respectively in one test and 300 and 6 respectively in another test. Non-crosslinked polymers were found on the thermoplastic when the average x and y values were 125 and 0.45 respectively in one test and 150 and 0.3 respectively in another test.

EXAMPLE 6

Polyethylene terephthalate woven fabrics were treated as in Example 1 with a commercial fabric treatment (composition A) and an aqueous emulsion of composition B of Example 1. A third sample was similarly processed as a control except that it was not exposed to a polydiorganosiloxane. After being heated to 205° C. for 90 seconds the three samples were evaluated for soil release using AATCC test method 130-1974. This test consists of forcing a mineral oil stain into the fabric with a 5 pound weight and then washing the stained fabric. Any residual stain is rated on a scale of 1 to 5. Since no difference existed between the control sample and the sample treated with composition B, the test was modified using dirty number 90 motor oil instead of the mineral oil. Thereafter, sample treated with composition A received the poorest rating of 1, the control received a better rating of 2 and the sample treated with composition B according to this invention received a higher rating of 4.

EXAMPLE 7

Several fabrics (25×50 cm. pieces scoured as in Example 1) were washed simultaneously in a Sears Lady Kenmore® automatic washer using a 10 minute normal cycle, hot (51° C.) wash and rinse water, low water level (8 gals.) and 30 grams of commercial anionic detergent (Dash®). During the rinse cycle 50 grams of a 30 weight percent emulsion of polydiorganosiloxane in water was automatically added to the washer. The emulsified polydiorganosiloxane was a 3-mercaptopropyldimethoxysiloxane-endblocked polydimethylsiloxane fluid having a viscosity of approximately 50 millipascal-seconds. At the completion of a complete washer cycle the fabrics were dried at 65° C. for 25 minutes in an air-circulating oven to approximately typical drying conditions in an automatic clothes dryer. The unwashed fabrics and the washed and dried fabrics were examined for hand as described in Example 4, for spray rating as described in AATCC Test No. 22-1974 and for water holdout as described in AATCC Test No. 39-1974. Results are summarized in Table II. This example shows how textiles may be improved in a home washer process.

TABLE II

| Fabric | Properties Before Washing | | | Properties After Drying | | |
|---|---|---|---|---|---|---|
| | Hand* | Spray Rating | Water Holdout | Hand* | Spray Rating | Water Holdout |
| PET (Type 54 Staple) | C | 0 | >1 min. | VG | 70 | >1 min. |
| PET (Flower Print) | G | 0 | >1 min. | VG | 50 | >1 min. |
| PET (Green) | P | 0 | >1 min. | E | 80 | >1 min. |
| PET (Fire-retarded) | G | 0 | >1 min. | E | 70 | >1 min. |
| Cellulose Acetate | VP | 0 | 5 sec. | L | 0 | >1 min. |
| Acetate/PET (68/32) | VP | 0 | 7 sec. | L | 0 | >1 min. |
| Cotton (Unbreached) | P | 0 | 0 | G | 0 | 0 |
| Cotton/PET (50/50) | P | 0 | 7 sec. | G | 0 | >1 min. |
| Nylon 6 Knit | Gr | 0 | 0 | L | 70 | >1 min. |
| Nylon 6 Knit (Print) | P | 0 | 0 | L | 0 | >1 min. |
| Acrylic Knit | VC | 0 | 0 | I | 0 | >1 min. |
| Modacrylic Pile | P | — | 15 sec. | E | — | >1 min. |

*C = Coarse, E = Excellent, I = Improved, G = Good, Gr = Grabby, L = Luxurious, P = Poor, V = Very

EXAMPLE 8

The washing and drying process of Example 7 was repeated five times using 9 gram samples of four fabrics which had been previously scoured as in Example 1. In run number one, 50 grams of the polydiorganosiloxane emulsion of Example 7 was added to the rinse water. In run number two 50 grams of a 30 weight percent aqueous emulsion of a trimethylsiloxane-endblocked polydiorganosiloxane copolymer containing approximately 98 dimethylsiloxane units and approximately 2 methyl-3-mercaptopropylisloxane units per molecule was added to the rinse water. In run number three 50 grams of a commercial fabric softener (Downy®) was added to the rinse water. In run number four 50 grams of a 30 weight percent aqueous emuslion of a mixture of 10 weight percent methyltrimethoxysilane and 90 weight percent of a hydroxyl-endblocked polydimethylsiloxane having a viscosity of approximately 80 millipascal-seconds was added to the rinse water. In run number five nothing was added to the rinse water. The washed and dried fabrics were examined for hand, spray rating, and water drop holdout as in Example 7. Results are summarized in Table III.

The fire-retarded polyethylene terephthalane (PET) fabrics from run numbers 1 and 3 were rewashed in the automatic washer, with nothing being added to the rinse water, to test the durability of the treatement. The fabric that was treated with Downy® experienced a decrease of spray rating from 50 to 0 and hand from good to poor. The fabric of this invention experienced a decrease of spray rating from 70 to 50 and of hand from excellent to very good.

The fire-retarded PET fabrics from all five runs were examined for crosslinked polymers on the fiber surface according to the process of Example 1. Crosslinked polydiorganosiloxanes were formed on the fabrics from runs 1 and 2.

TABLE III

| Fabric | Run No.** | Properties After Drying | | |
|---|---|---|---|---|
| | | Hand* | Spray Rating | Water Holdout |
| PET (Fire Retarded) | 1 | E | 70 | >1 min. |
| | 2 | E | 90 | >1 min. |
| | 3 | G | 50 | >1 min. |
| | 4 | P | 0 | >1 min. |
| | 5 | P | 0 | >1 min. |
| PET (Green) | 1 | VG | 80 | >1 min. |
| | 2 | G | 90 | >1 min. |
| | 3 | G | 0 | 15 sec. |
| | 4 | G | 0 | 10 sec. |
| | 5 | G | 0 | >1 min. |
| Nylon 6 Knit | 1 | E | 90 | >1 min. |
| | 2 | L | 90 | >1 min. |
| | 3 | VG | 0 | 30 sec. |
| | 4 | G | 0 | 11 sec. |
| | 5 | G | 0 | 0 |
| Acetate/PET (68/32) | 1 | VG | 0 | >1 min. |
| | 2 | VG | 70 | >1 min. |
| | 3 | G | 0 | 0 |
| | 4 | P | 0 | 5 sec. |
| | 5 | P | 0 | >1 min. |

*E = Excellent, G = Good, L = Luxurious, P = Poor, V = Very
**Runs 3, 4, and 5 are for comparative purposes.

That which is claimed is:

1. A method for treating a condensation-polymer fiber or a cellulosic fiber which comprises applying to said fibers a liquid composition consisting essentially of a polydiorganosiloxane having a viscosity of at least 20 millipascal-seconds at 25° C., said polydiorganosiloxane consisting essentially of (A) siloxane units of the unit formula $$R_nSi(OR'')_mO_{(4-m-n)/2}$$

wherein m=0, 1 or 2, n=1, 2 or 3, and the sum of m+n=2 or 3, R denotes a silicon-bonded radical free of aliphatic unsaturation selected from the group consisting of monovalent hydrocarbon radicals and halogenated monovalent hydrocarbon radicals, and R'' denotes a lower alkyl radical and, (B) siloxane units of the unit formula $$HSR'SiR_x(OR'')_yO_{(d-x-y)/2}$$

wherein R and R'' are as denoted above, R' denotes a divalent saturated hydrocarbon radical having one valence bonded to the silicon atom and one valence bonded to the sulfur atom or a trivalent saturated hydrocarbon radical having two valences singly bonded to the silicon atom and one valence bonded to the sulfur atom, the values of d, x and y being such that when R' is divalent d=3, x=0, 1 or 2, y=0, 1 or 2 and the sum of x+y=1 or 2 and when R′ is trivalent d=2, x=0 or 1, y=0 or 1 and the sum of x+y=0 or 1, there being an average of at least one HSR′—radical in addition to at least one —OR″ radical or another HSR′—radical in the polydiorganosiloxane and heating the applied polydiorganosiloxane whereby there is obtained a fiber having durably affixed to the surface thereof a crosslinked polydiorganosiloxane.

2. The method of claim 1 wherein the polydiorganosiloxane comprises greater than 90 percent dimethylsiloxane units, based on the total number of diorganosiloxane units in the polydiorganosiloxane.

3. The method of claim 2 wherein R′ denotes —$CH_2CH_2CH_2$—.

4. The method of claim 2 wherein the polydiorganosiloxane comprises siloxane units having the formulae

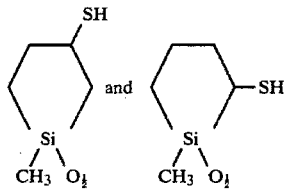

5. The method of claim 1 wherein the polydiorganosiloxane consists essentially of $(CH_3)_3SiO_{1/2}$ units, $(CH_3)_2SiO_{2/2}$ units, and $HSCH_2CH_2CH_2(CH_3)SiO_{2/2}$ units.

6. The method of claim 1 wherein the polydiorganosiloxane consists essentially of $(CH_3)_2SiO_{2/2}$ units and $HSCH_2CH_2CH_2(CH_3O)_2SiO_{1/2}$ units.

7. The method of claim 1 wherein the fiber consists essentially of a condensation polymer selected from the class consisting of polyesters and polyamides free of aliphatic unsaturation.

8. The method of claim 5 wherein the condensation polymer is polyethylene terephthalate.

9. The method of claim 6 wherein the condensation polymer is polyethylene terephthalate.

10. A fiber produced in accordance with the method of claim 1.

11. A fiber produced in accordance with the method of claim 7.

* * * * *

UNITED STATES PATENT AND TRADEMARK OFFICE

CERTIFICATE OF CORRECTION

PATENT NO. : 4,311,760

DATED : January 19, 1982

INVENTOR(S) : Robert E. Kalinowski, Jonathan Lipowitz

It is certified that error appears in the above-identified patent and that said Letters Patent is hereby corrected as shown below:

In column 6, line 26, "50 to 500" should read

-- 50 to 5000 --.

Signed and Sealed this

*Ninth* Day of *October 1984*

[SEAL]

*Attest:*

GERALD J. MOSSINGHOFF

*Attesting Officer*

*Commissioner of Patents and Trademarks*